US011433442B2

(12) United States Patent
De Luca et al.

(10) Patent No.: US 11,433,442 B2
(45) Date of Patent: Sep. 6, 2022

(54) CONTINUOUS CASTING AND ROLLING PLANT FOR THE PRODUCTION OF METALLURGICAL PRODUCTS

(71) Applicant: DANIELI & C. OFFICINE MECCANICHE S.p.A., Buttrio (IT)

(72) Inventors: Andrea De Luca, Remanzacco (IT); Daniele Andreatta, Borso del Grappa (IT); Federico Tortul, Gradisca d'Isonzo (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 17/043,556

(22) PCT Filed: Apr. 3, 2019

(86) PCT No.: PCT/IB2019/052724

§ 371 (c)(1),
(2) Date: Sep. 29, 2020

(87) PCT Pub. No.: WO2019/193512

PCT Pub. Date: Oct. 10, 2019

(65) Prior Publication Data

US 2021/0023595 A1 Jan. 28, 2021

(30) Foreign Application Priority Data

Apr. 3, 2018 (IT) ..... 102018000004170

(51) Int. Cl.
*B21B 1/46* (2006.01)
*B22D 11/16* (2006.01)
*B22D 11/126* (2006.01)

(52) U.S. Cl.
CPC ..... *B21B 1/466* (2013.01); *B22D 11/126* (2013.01); *B22D 11/163* (2013.01)

(58) Field of Classification Search
CPC ..... B21B 1/466; B22D 11/126; B22D 11/148; B22D 11/163
See application file for complete search history.

(56) References Cited

U.S. PATENT DOCUMENTS 5,769,149 A * 6/1998 Mertens ..... B21B 1/466 164/418
5,771,560 A 6/1998 Meroni et al.
(Continued)

FOREIGN PATENT DOCUMENTS

DE 102016216727 3/2018

OTHER PUBLICATIONS

Patent Cooperation Treaty, International Search Report and Written Opinion for International Application No. PCT/IB2019/052724, dated Jun. 13, 2019, 11 pages.

*Primary Examiner* — Kevin E Yoon
*Assistant Examiner* — Jacky Yuen
(74) *Attorney, Agent, or Firm* — Stetina Brunda Garred and Brucker

(57) ABSTRACT

A continuous casting and rolling plant for the continuous production of steel bars or profiles, the plant comprising in sequence, along a processing line, a continuous casting machine adapted to cast a billet; a first cutting device; a second cutting device; a rolling train adapted to roll the billet; wherein the continuous casting machine comprises a crystallizer, and is adapted to cast the billet at least at a first casting speed $v_1$ and at a second casting speed $v_2$ greater than the first casting speed $v_1$; wherein the first cutting device is arranged at a first distance from the crystallizer expressed in meters, along the processing line, calculated according to a specific mathematical relation.

21 Claims, 4 Drawing Sheets

(56) References Cited

U.S. PATENT DOCUMENTS

| | | | | |
|---|---|---|---|---|
| 2010/0116380 | A1* | 5/2010 | Seidel | B21B 1/466<br>148/624 |
| 2010/0147484 | A1 | 6/2010 | Rosenthal et al. | |
| 2012/0160377 | A1 | 6/2012 | Seidel et al. | |

* cited by examiner

CONTINUOUS CASTING AND ROLLING PLANT FOR THE PRODUCTION OF METALLURGICAL PRODUCTS

CROSS-REFERENCE TO RELATED APPLICATIONS

This application claims priority to PCT International Application No. PCT/IB2019/052724 filed on Apr. 3, 2019, which application claims priority to Italian Patent Application No. 102018000004170 filed on Apr. 3, 2018, the disclosures of which are expressly incorporated herein by reference.

STATEMENT RE: FEDERALLY SPONSORED RESEARCH/DEVELOPMENT

Not applicable.

FIELD OF THE INVENTION

The present invention relates to a continuous casting and rolling plant for the production of metallurgical products, such as long metal products, and to a relative emergency procedure in the event of the rolling train stopping, whether accidental, for example due to cobbles or accident, or programmed, for example due to the changing of the worn cylinders or production changes.

BACKGROUND ART

Conventional continuous casting and rolling plants, used for the production of long metal products, such as steel bars or profiles, provide that the machinery forming the casting line are not arranged in line with the rolling mill. The production line, therefore, has points of interruption.

In fact, in standard plants, the casting line is disconnected from the rolling line, so that the cast products, for example billets, are cut and stored in special warehouses. From such warehouses, the billets are then sent to the heating furnace, conventionally gas-fired, which brings them to a temperature suitable for being rolled in the rolling line, which is usually downstream of the heating furnace. Often the casting line and the rolling mill are arranged in different areas of the plant.

Therefore, there are considerable limits to the efficiency and productivity of the plant, linked to the fact that the continuous casting machine and the rolling train still work partially disconnected, without continuity, and the need for an intermediate storage meeting the different operational needs of these components remains.

A second generation of plants has overcome these limits by arranging the machines of the plant, including the machines forming the casting line and the rolling mill, along a same production line.

In particular, in such second generation of plants, a single product advancement line is defined without intermediate storage and collection of material.

A continuous casting and rolling process in semi-endless or billet-to-billet mode is thus allowed, in which upstream of the rolling mill the billet is first cut to length in billet segments or portions.

A continuous casting and rolling process in endless mode is also possible, i.e., seamlessly, in which the casting machine and the rolling mill are directly connected to and in direct contact with each other and the rolled product is cut to length only downstream of the rolling mill.

In any case, the plants of this second generation have a considerably higher productivity, and are also more compact with respect to the previous type of plants.

Although being particularly advantageous, this second generation of plants can be further improved, both in terms of the size of the plant—which significantly affects the cost of building the plant itself—and in terms of energy efficiency.

In fact this type of plant provides that the distance between the nominal level of the meniscus (level of the liquid steel in the crystallizer when the line produces at average productivity) and the first cutting device encountered by the cast product, downstream of the casting line, is always greater (with a certain safety margin) than the metallurgical length which is determined at the maximum productivity of the plant, which is a function of the cast section of the greatest size provided for the line, at the maximum casting speed allowed. Thereby, said first cutting device cuts a billet which is always completely solidified.

This, however, involves a considerable overall length of the plant, and therefore of the sheds, and a relative high construction cost (about 80 k€/meter of length). A considerable length of installation also corresponds to a greater thermal dissipation of the cast product, which must be recovered (for example, by means of special heating furnaces arranged in line) so as to be able to roll under optimal conditions. This results in an additional cost and a waste of energy.

Furthermore, in the endless operation mode, the rolling process and the casting process are rigidly connected; therefore, each minimum stop of the rolling mill, for example due to a programmed change of the rolling cylinders or to the execution of checks, or due to accidents, sudden interruptions or minor breakdowns, forcibly makes the continuous casting process, as well as the process of the meltshop upstream, stop, with loss of production.

In the endless operation mode, therefore, a stop of the rolling train involves a reduction in productivity and in the use factor of the plant as well as an increase in operating costs, and is the main cause of an increase in the energy required.

SUMMARY OF THE INVENTION

It is an object of the present invention to reduce the size of a continuous casting and rolling plant for the continuous production of long metal products.

It is another object of the invention to provide an in-line casting and rolling process, in endless or semi-endless mode, and to set up a relative production plant which allows to manage the stops of the rolling train, substantially without stopping the casting and therefore without loss of production and without penalizing the meltshop upstream.

It is a further object of the invention to reduce to a minimum or to eliminate the waste of material in emergency situations or during the programmed stops of the rolling mill, and, in any case, to completely recover the product which in such situations is temporarily accumulated at an intermediate point outside the production line.

It is a further object of the invention to make the most of the enthalpy of the starting liquid steel along the entire production line so as to obtain a considerable energy saving and a reduction in operating costs with respect to conventional processes.

The present invention achieves at least one of such objects, and other objects which will become apparent in the light of the present description, by means of a continuous casting and rolling plant for the continuous production of long metal products, such as steel bars or profiles or sections or wire rods, the plant comprising, in sequence, along a processing line a continuous casting machine adapted to cast a billet;

a first cutting device;

a bed;

a second cutting device;

a rolling train adapted to roll the billet;

wherein the continuous casting machine comprises a crystallizer, and is adapted to cast the billet at least at a first casting speed $v_1$ and at a second casting speed $v_2$ greater than the first casting speed $v_1$;

wherein the first cutting device is arranged at a first distance A from the crystallizer expressed in meters, along the processing line, which satisfies the following relation:

$$v_1 \cdot \left(\frac{d_{min}}{k}\right)^2 < A < v_2 \cdot \left(\frac{d_{min}}{k}\right)^2$$

where $d_{min}$=minimum distance between the center of the billet and the outer surface of the billet, expressed in mm, considering the maximum cross section of the billet according to the plant design, k=solidification coefficient, expressed in $mm/min^{0.5}$, and where the first casting speed $v_1$, expressed in m/min, is the maximum casting speed at which the closure of the liquid cone of the billet occurs before said bed;

and the second casting speed $v_2$, expressed in m/min, is the maximum continuous casting speed, and possibly also rolling speed, at full capacity, according to the plant design.

According to a further aspect of the invention, an emergency procedure is provided for the aforesaid continuous casting and rolling plant, operating at full capacity at said second casting speed $v_2$, said emergency procedure comprising the following steps in case stopping the rolling in the rolling train is required:

a) cutting, preferably scrapping, the billet by means of the second cutting device;

b) reducing the casting speed of the continuous casting machine from the second casting speed $v_2$ to a third casting speed v', lower than the first casting speed $v_1$;

c), cutting, preferably cutting to length, the billet by means of the first cutting device, optionally after a time t from reaching said third casting speed v' wherein the time t is given by the following relation:

$$t \geq \left(\frac{d_{min}}{k}\right)^2 * \left(\frac{v_2 - v_1}{v_2 - v'}\right).$$

In particular, said minimum distance $d_{min}$ is calculated considering the maximum cross section of the billet cast along a plane orthogonal to the processing line, and represents the shortest path of the heat from the center of the billet towards the outer surface thereof.

As it will be understood from the present description, advantageously, a plant designed to operate according to the method of the invention has a particularly compact size.

The inventors have identified that an important aspect which allows the realization of a compact plant is the positioning of the first cutting device, i.e., the one arranged downstream of and proximal to the crystallizer and to the possible straightening unit, with respect to the solidification starting area, i.e., with respect to the crystallizer.

As is well known to those skilled in the art, the metallurgical length $L_m$ is the distance between the level of the meniscus of liquid steel in the crystallizer and the point of complete solidification of the cast product, or closure point of the liquid cone, also known as kissing point.

The metallurgical length is directly proportional to the casting speed and to the size of the cross section of the billet which is cast and therefore to the productivity of the casting machine.

Therefore, as the casting speed and/or the casting section increases, the distance between the kissing point and the level of the steel meniscus in the crystallizer also increases.

That being said, it should be considered that a plant in accordance with the invention can work both in endless mode and in semi-endless mode.

In particular, the endless mode can be used, for example, for the production of bars for reinforced concrete, so-called rebars (abbreviation of the term "steel reinforcing bars"), and of most of the profiles or sections, while the semi-endless mode can be used as an operating mode for the production of those sections or profiles which, due to the particular geometric conformation thereof, can not be processed in the endless mode for quality reasons. The sections to be rolled in semi-endless mode are, for example, the so-called "C" profiles or "U" profiles (commercially known as "channels") which require a particular control of the temperature along the rolling train, since the ends of the profile (wings) tend to cool down faster. In such case, the train works at the maximum rolling speed allowed, in order to limit thermal losses, said maximum rolling speed allowed being, anyway, unattainable by the casting machine.

The semi-endless mode is also used as a transient mode when starting the plant before reaching the endless operating mode. Furthermore, the semi-endless mode can be used as an emergency mode in the event of a rolling train stopping, as better explained below.

In the case of rebar production, downstream of the rolling train, the rolled product can be packaged in the form of bundled bars in or in the form of bar spools or wire rod spools.

When the plant operates at full capacity, in endless or in semi-endless mode, the casting speed of the casting machine is equal to a value at full capacity $v_2$. Such speed $v_2$ coincides with the rolling speed only in the endless mode.

Advantageously, the first cutting device downstream of the casting line, according to the present invention, is positioned at a distance A from the crystallizer, such distance being lower than the metallurgical length $L_m$ calculated as a function of the casting speed $v_2$ and being greater than the metallurgical length calculated as a function of the casting speed $v_1$. Such speed $v_1$ is the maximum casting speed at which the product (billet) of the greatest cross section, provided by the plant design, can be cast, and at which the closure of the liquid cone of the billet occurs before the bed.

The bed, also named cooling bed (the cooling occurring naturally in the air), or lateral discharging table or side buffer, consists of a substantially horizontal collection plane, placed outside the production line and cooperating therewith, adapted to at least temporarily accumulate billet segments or portions of a predefined length during the programmed or accidental stops of the rolling mill. In particular, the bed is arranged laterally with respect to the advancement axis of the billet along the processing line. The billet segments unloaded on the lateral discharging table naturally cool in the air and are suitable for the sale as such.

Thereby, it is possible to obtain a particularly compact plant, since the distance between the first cutting device and the casting machine is relatively short. In fact, in the known solutions, the first cutting device is always placed downstream of the closure of the cone or liquid core, i.e., it is placed at a distance from the crystallizer which is greater than the metallurgical length $L_m$ calculated as a function of the casting speed at full capacity $v_2$, and such distance increases as the productivity of the plant increases.

This aspect of the invention is advantageously reflected on energy consumption and on the construction costs of the plant. In fact, since the aforesaid distance is relatively short, the distance between the casting machine and the first rolling stand of the rolling mill is also relatively short. Therefore, the thermal losses of the billet on the path thereof from the casting machine to the rolling mill are considerably limited. Furthermore, the heating furnace, conventionally of the induction type, placed upstream of the rolling mill or, in any case, between the bed and the rolling mill, can work at lower operating temperatures and therefore at lower powers.

The nearing of the rolling mill to the continuous casting machine thus allows a saving in construction terms, by virtue of the sheds of smaller size and fewer civil works, without counting the energy savings in the heating furnace following the arrival of a warmer material, given the shorter travel distance and, therefore, the lesser thermal dispersion. Such energy saving may, for example, be quantified in about 10-15 kWh/ton.

As known, situations can arise in which stopping the rolling is required. In particular, faults or problems can occur in the rolling train. For example, a cobble can occur in the rolling train, or the entry of material must be stopped during maintenance steps in which worn components must be changed, or the section of the rolling channels must be changed, etc.

When stopping the rolling is required, in accordance with the invention, a procedure is started, hereinafter called "emergency" procedure (the term emergency covers both the case of the accidental stops and the case of the programmed stops of the rolling mill), which involves the cutting of the billet, first by means of the second cutting device, distal from the crystallizer and from the possible straightening unit, and subsequently by means of the first cutting device, proximal to the crystallizer and to the possible straightening unit.

According to the procedure of the invention, in fact, the casting speed is reduced from the speed at full capacity $v_2$ to an emergency speed v' and, therefore, the first cutting device is activated only after the withdrawal of the liquid cone, and therefore of the kissing point, upstream of the first cutting device with a reliable safety margin, preferably after the aforesaid predetermined time t.

Therefore, when the first cutting device is activated, the latter will operate on a billet which is always completely solidified.

Instead, if the casting machine continues working at the casting speed $v_2$, the kissing point would be upstream of the second cutting device but downstream of the first cutting device, which would disadvantageously operate on a billet still partially liquid, with a consequent leakage of the liquid metal.

Preferably, the third casting speed, or emergency speed, v' is the minimum casting speed according to the plant design. For example, said emergency speed v' is the minimum casting speed which can be reached by the continuous casting machine without incurring safety risks, i.e., the speed below which the casting machine incurs castability problems (for example, for the "chilling" of the liquid steel in the tundish).

Further features and advantages of the invention will become more apparent in the light of the detailed description of exemplary, but not exclusive, embodiments.

The dependent claims describe particular embodiments of the invention.

BRIEF DESCRIPTION OF THE FIGURES

In the description of the invention, reference is made to the attached drawings, provided by way of explanation and not by way of limitation, in which.

DESCRIPTION OF EXEMPLARY EMBODIMENTS OF THE INVENTION

Figure 1:
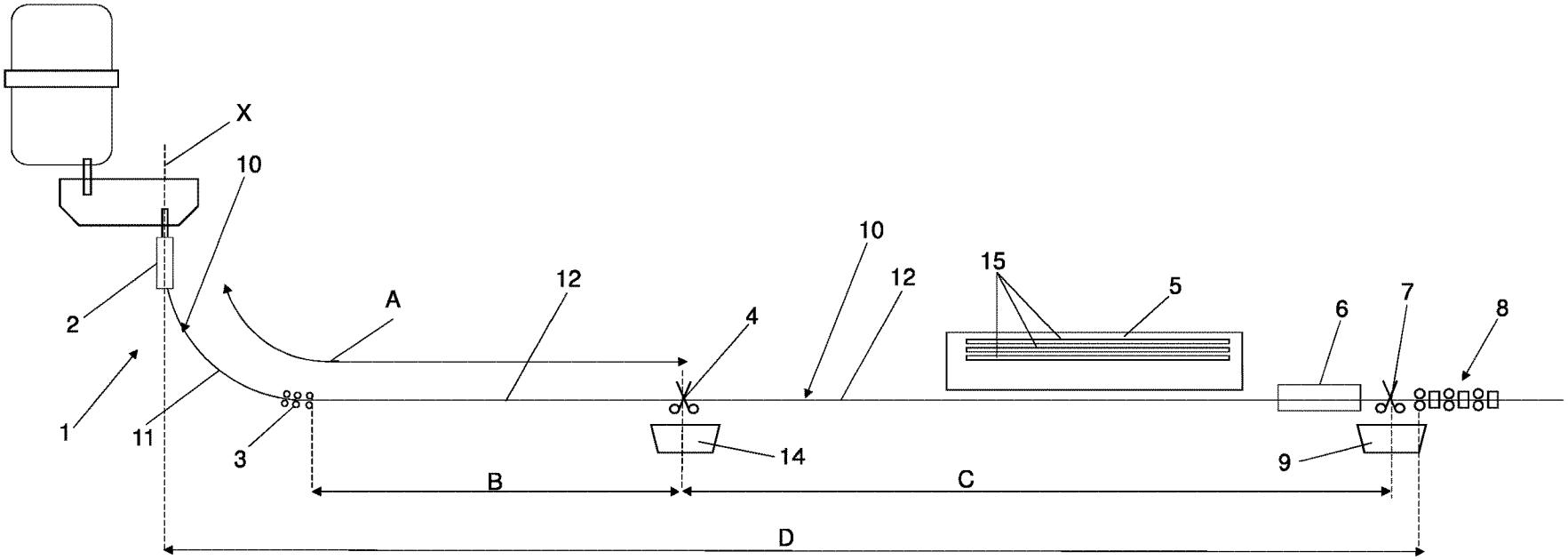
FIG. 1 shows a diagram of the continuous casting and rolling plant in accordance with the invention.

With reference to FIG. 1, an example of continuous casting and rolling plant in accordance with the invention is shown.

The plant comprises the following components in sequence along a single processing line 10:

- a continuous casting machine 1, adapted to cast a billet which can have a cross section, for example, with a polygonal (for example, square, rectangular, hexagonal, octagonal, etc.) or round shape;
- a first cutting device 4;
- at least one bed 5, for example a lateral discharging table, arranged laterally with respect to the advancement axis of the billet;
- a second cutting device 7;
- a rolling train 8 adapted to roll the billet.

As known, the continuous casting machine 1 casts a billet still containing a liquid core, while the rolling train 8 rolls the completely solidified billet.

The continuous casting machine 1 comprises a crystallizer 2, and is adapted to cast the billet at different casting speeds, in particular at least at a first casting speed $v_1$ and at a second casting speed $v_2$ greater than the first casting speed $v_1$. The first casting speed $v_1$, expressed in m/min, is the maximum casting speed at which the closure of the liquid cone of the billet occurs before the bed 5; while the second casting speed $v_2$, expressed in m/min, is the maximum casting speed at full capacity, and possibly also the continuous rolling speed at full capacity, according to the plant design.

The first cutting device 4 is arranged at a first distance A, expressed in meters, from the crystallizer 2, in particular from the exit section of said crystallizer.

Said first distance A is measured along the processing line 10 comprising a curved stretch 11, comprising the casting curve, and a rectilinear stretch 12 along which both the first cutting device 4 and the second cutting device 7 are arranged. Therefore, the first distance A is measured along the curved stretch 11 and along a portion of the rectilinear stretch 12 immediately following said curved stretch 11.

Advantageously, the first distance A satisfies the following relation:

$$v_1 \cdot \left(\frac{d_{min}}{k}\right)^2 < A < v_2 \cdot \left(\frac{d_{min}}{k}\right)^2$$

where $d_{min}$=minimum distance between the center of the billet and the outer surface of the billet, expressed in mm, considering the maximum cross section of the billet according to the plant design, k=solidification coefficient, expressed in mm/min$^{0.5}$, $v_1$=first casting speed, expressed in m/min, $v_2$=second casting speed, expressed in m/min.

In other words, $d_{min}$ is the minimum distance between the central axis of the crystallizer and the inner surface of the crystallizer, expressed in mm, considering the maximum cross section of the crystallizer according to the plant design, i.e., the maximum casting section according to the plant design.

In the case of a regular polygonal cross section, this minimum distance corresponds to the apothem of the polygon.

In the case of a round cross section, this minimum distance corresponds to the radius of the billet.

The solidification coefficient k of the product is generally recognized in the background art to be referred to the following table:

| Cast product | Dimensional parameter | k value [mm/min$^{0.5}$] |
|---|---|---|
| Slab | short side/long side ratio = 1:4 | 26-29 |
| Large bloom | thickness > 400 mm | 25-27 |
| Medium bloom | thickness 200-400 mm | 26-28 |
| Small bloom/billet | thickness < 200 mm | 27-30 |
| Large rounds | thickness > 200 mm | 28-30 |
| Small rounds (billets) | thickness < 200 mm | 30-32 |

For the billets, the solidification coefficient k is equal to a value in the range of 27 and 32 mm/min$^{0.5}$, and mainly depends on the shape of the billet cross section and, to a lesser extent, on the size. For example, in the case of a square-section billet casting, k can have a value equal to about 28-29 mm/min$^{0.5}$, while in the case of an octagonal-section billet (similar to a small round), k can have a value equal to about 32 mm/min$^{0.5}$.

The second casting speed $v_2$ is the casting speed in the operation at full capacity. Such speed is equal to the speed of the rolling train 8 at full capacity in the endless operating mode of the plant.

Preferably, said second casting speed $v_2$ has a value in the range of 5.1 m/min and 9 m/min, even more preferably between 5.9 and 6.5 m/min.

The first casting speed $v_1$ is the maximum casting speed at which the billet of the greatest cross section, according to the plant design, can be cast, and at which the closure of the liquid cone of the billet occurs before the bed 5.

Preferably, said first casting speed $v_1$ has a value in the range of 4.1 m/min and 5 m/min, even more preferably between 4.3 and 4.8 m/min.

Preferably the following relation exists between the first casting speed $v_1$ and the second casting speed $v_2$:

$$v_1 \leq 0.7 v_2.$$

The distance A is therefore advantageously comprised in a range of values calculated as a function of known design parameters of the plant.

Therefore, once chosen during the design step the following design parameters in a known manner the maximum cross section of the billet to be cast;

the maximum casting speed $v_2$ at full capacity;

the position of the bed 5 along the processing line 10;

the minimum distance $d_{min}$, the solidification coefficient k and the maximum casting speed $v_1$ (obtained by means of a common software), at which the closure of the liquid cone of the billet occurs before the bed 5, are known, since they can be directly calculated in a known manner starting from the aforesaid design parameters.

In an advantageous variant, the first distance A between the first cutting device 4 and the crystallizer 2, measured along the processing line, is shorter than 50 meters, even more preferably between 25 and 32 m.

In a particular variant, a straightening unit 3 can be provided between the curved stretch 11 and the rectilinear stretch 12 of the processing line 10.

Also the distance B between the straightening unit 3 and the first cutting device 4 is therefore advantageously reduced, preferably to between 10 and 20 m, for example, about 13-17 m.

The distance C between the first cutting device 4 and the second cutting device 7 is instead preferably between 35 and 40 m.

In the variant shown in FIG. 1, at least one heating furnace 6, preferably of the induction type, simply called inductor, is provided between the at least one bed 5 and the second cutting device 7 along the direction of advancement of the billet in the processing line. The inductor has the function of bringing the temperature of the billets to values suitable for the rolling, in particular to a value higher than about 1000° C., between about 1050 and about 1100° C., and of carrying out an equalization of the billet temperature. The equalization is carried out both longitudinally and on the cross section, in particular for heating the edges, thus avoiding the formation of cracks in these areas during the rolling. If for certain operating conditions the billets reach the inductor already at a temperature of about 1000° C., then providing for the operation of the inductor is not required, i.e., it can be activated so as to equalize the temperature. Said second cutting device 7, in turn, is arranged between said at least one heating furnace 6 and said rolling train 8.

Figure 2:
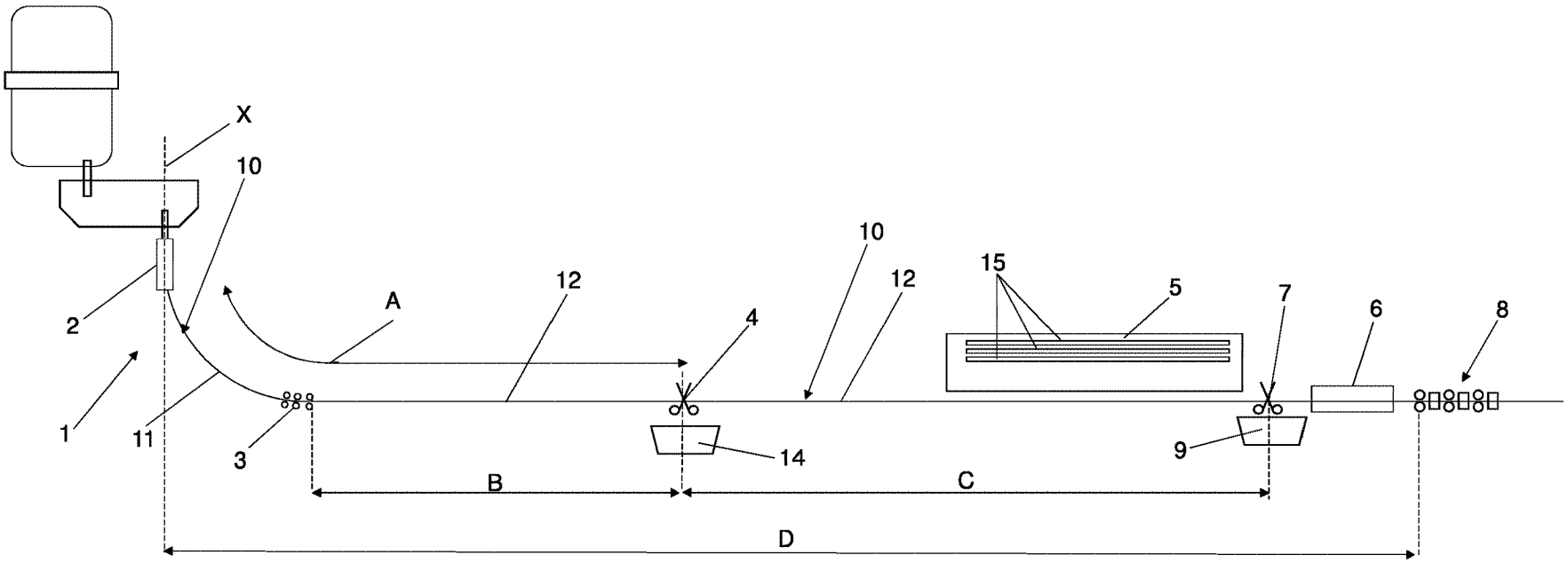
FIG. 2 shows a variant of the diagram of the plant of FIG. 1.

Alternatively, as shown in the variant of FIG. 2, the second cutting device 7 can be positioned between the at least one bed 5 and the at least one heating furnace 6, always upstream of the rolling train 8.

Figure 3:
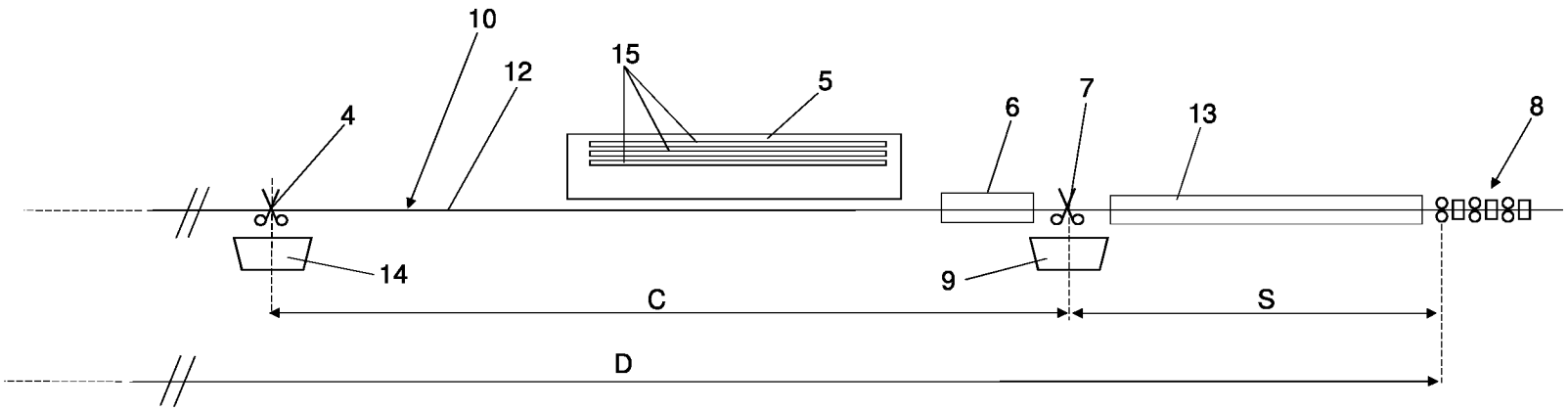
FIG. 3 shows a variant of the diagram of the plant of FIG. 1.

A third variant, shown in FIG. 3, provides the same arrangement of the components as the variant of FIG. 1, with the difference that the distance S between the second cutting device 7 and the first rolling stand of the train 8 is increased so as to create the space necessary to accommodate a billet segment of a length, for example of between about 10 meters and about 20 meters, and therefore allowing the semi-endless operating mode. Preferably, the distance S is between about 15 meters and about 25 meters. Optionally, a hood 13 for the maintenance of the billet temperature can be provided between the second cutting device 7 and the first rolling stand. Such hood can be active, i.e. equipped with heating devices, or it can be a passive hood, i.e., only insulated and without heating devices.

Figure 4:
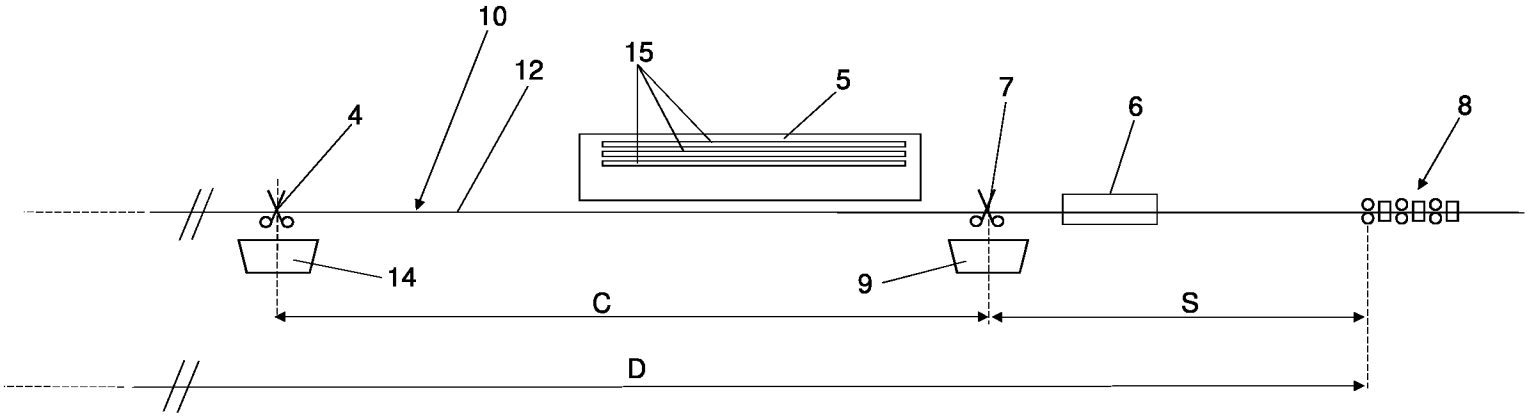
FIG. 4 shows a variant of the diagram of the plant of FIG. 2.

A fourth variant, shown in FIG. 4, provides the same arrangement of the components as the variant of FIG. 2, with the difference that the distance S between the second cutting device 7 and the first rolling stand of the train 8 is increased so as to create the space necessary to accommodate a billet segment of a length, for example of between about 10 meters and about 20 meters, and therefore allowing the semi-endless operating mode. Preferably, the distance S is between about 15 meters and about 25 meters.

Therefore the variants of FIG. 3 and of FIG. 4 are suitable to produce in semi-endless mode profiles or sections at high casting speed.

Preferably, the at least one heating furnace 6 and the at least one bed 5 are proximal to the second cutting device 7 and distal from the first cutting device 4.

Below or laterally with respect to the second cutting device 7, a collection container 9, or another suitable collection device, is provided for collecting the billet pieces which are scrapped by means of the aforesaid second cutting device 7. Such billet pieces have, for example, a variable size, from 500 mm to 800 mm.

Similarly, below or laterally with respect to the first cutting device 4, a collection container 14, or another suitable collection device, can be provided for collecting the billet pieces which are scrapped by means of the aforesaid first cutting device 4.

The at least one bed 5 is instead provided to receive the billet segments 15 which are cut to length by means of the first cutting device 4.

The plant just described is extremely compact. For example, the distance D, i.e., the linear distance between the casting axis X and the first stand of the rolling train 8 is between 70 and 95 m.

From the foregoing, it is therefore clear that a preferred embodiment of the plant of the invention comprises in sequence along the processing line 10 a continuous casting machine 1 adapted to cast a billet;

a first cutting device 4;

at least one bed 5;

a second cutting device 7;

a rolling train 8 adapted to roll the billet;

wherein the continuous casting machine 1 comprises a crystallizer 2;

wherein the first cutting device 4 is arranged at a distance A from the crystallizer 2, measured along the processing line 10, shorter than 50 meters, preferably comprised between 25 and 32 m;

preferably wherein a distance C, between 35 and 40 m, is provided between the first cutting device 4 and the second cutting device 7;

and preferably wherein a distance D, between 70 and 95 m, is provided between the crystallizer 2, in particular between the casting axis X, and the rolling train 8.

Optionally, a distance S between the second cutting device 7 and a first rolling stand of the rolling train 8 is between about 15 and 25 meters.

In this preferred embodiment, the processing line 10 comprises a curved stretch 11, comprising a casting curve, and a rectilinear stretch 12 along which the first cutting device 4 and the second cutting device 7 are arranged. Preferably, a straightening unit 3 is provided between said curved stretch and said rectilinear stretch. For example, the distance B between the straightening unit 3 and the first cutting device 4 is between 10 and 20 m. At least one heating furnace 6, preferably of the induction type, is provided between the bed 5 and the second cutting device 7 or between the second cutting device 7 and the rolling train 8.

Advantageously, in all the embodiments of the plant of the invention, the first cutting device 4 and the second cutting device 7 are the only cutting devices present along the processing line stretch between the crystallizer 2 and the rolling train 8.

For example, the first cutting device 4 can be a hydraulic shear, an oxyacetylene torch or another suitable cutting tool for cutting the billet preferably at low advancement speeds, for example between about 3 and about 5 m/min. Instead, the second cutting device 7 can be, for example, a hydraulic shear or another suitable cutting tool for cutting the billet preferably at high advancement speeds, for example between about 5 and about 9 m/min.

In the operation of the plant of the invention in the endless operating mode (variants of FIG. 1 and FIG. 2) the continuous casting machine 1 starts casting at a reduced speed $v_1$, preferably lower than 4.5 m/min, and the first cutting device 4 cuts the head of the billet to eliminate the cold part on which the dummy bar was grafted. The cutting device 4 then continues cutting billet segments of a predefined length, between 10 and 15 meters, for example of 12 meters, feeding the rolling train 8 in a semi-endless mode, while the casting speed is progressively increased. The induction heating furnace 6 heats the billet up to the rolling temperature. When the casting speed reaches the full capacity value $v_2$, for example of 6 m/min, which coincides with the speed of the rolling train 8, then the first cutting device 4 stops the cutting action thereof and the rolling in endless mode starts.

In the operation of the plant of the invention in the semi-endless operating mode (variants of FIG. 3 and FIG. 4) the continuous casting machine 1 starts casting at a reduced speed, preferably lower than 4.5 m/min, and the first cutting device 4 cuts the head of the billet to eliminate the cold part on which the dummy bar was grafted. The cutting device 4 then continues cutting billet segments of a predefined length, between 10 and 15 meters, for example of 12 meters, feeding the rolling train 8 in a semi-endless mode, while the casting speed is progressively increased. The induction heating furnace 6 heats the billet up to the rolling temperature. The casting speed is increased up to the full capacity value $v_2$, for example of 5 m/min. At this point, the first cutting device 4 stops the cutting action thereof and the second cutting device 7 takes over to cut billet segments to length in a semi-endless mode, feeding the rolling train 8.

Considering the operation of the plant of the invention, in the endless or semi-endless operating modes described above, which works at full capacity at the second casting speed $v_2$, the emergency procedure in accordance with the invention, if stopping the rolling in the rolling train 8 is required, comprises the following steps:

a) cutting, preferably scrapping, the billet by means of the second cutting device 7;

b) reducing the casting speed of the continuous casting machine 1 from the second casting speed $v_2$ to an emergency speed v', for example equal to 3.5 m/min, lower than the first casting speed $v_1$;

c), cutting, preferably cutting to length, the billet by means of the first cutting device 4, preferably after a time t upon reaching said third emergency speed v'; in which the time t is given by the following relation:

$$t \geq \left(\frac{d_{min}}{k}\right)^2 * \left(\frac{v_2 - v_1}{v_2 - v'}\right)$$

The second casting speed $v_2$ is equal to the speed of the rolling train 8 at full capacity only in the endless operating mode of the plant.

The first casting speed $v_1$ is the maximum casting speed at which the billet of greatest cross section, according to the plant design, can be cast, and at which the closure of the liquid cone of the billet occurs before the bed 5.

The emergency speed v' is preferably the minimum casting speed according to the plant design. For example, said emergency speed v' is the minimum casting speed which can be reached by the continuous casting machine without incurring safety risks, i.e., the speed below which the casting machine incurs castability problems (for example, for the "chilling" of the liquid steel in the tundish).

Preferably the first casting speed $v_1$ is equal to a value in the range of 4.1 m/min and 5 m/min, the second casting speed $v_2$ is equal to a value in the range of 5.1 m/min and 9 m/min, and the emergency speed v' is lower than $v_1$ and is, for example, equal to a range of between 3 and 4 m/min.

During step a) the billet, advancing at the casting speed $v_2$, is scrapped by means of the second cutting device 7 producing billet pieces which are unloaded into the collection container 9.

Gradually, during step b), the casting speed is reduced from $v_2$ to the emergency speed v'. Preferably, during step b) the second cutting device 7 continues scrapping the billet producing billet pieces which are unloaded into the collection container 9.

After the aforesaid time t from the reaching of said emergency speed v', which advantageously ensures, with a wide safety margin, the withdrawal of the kissing point from the area between the first cutting device 4 and the second cutting device 7 to the area upstream of the first cutting device 4, said first cutting device 4 starts cutting the billet to length while the second cutting device 7 does no longer scrap. The billet segments 15 of a predefined length thereby obtained are unloaded laterally on the at least one bed 5. Known thrusting devices (not shown in the Figures) are provided to laterally push, in a known manner, these billet segments 15 from the advancement axis of the billet towards the bed 5 or the lateral discharging table.

By cutting to length with the first cutting device 4, the casting is disconnected from the rolling and the semi-endless mode is performed, not as an operating mode (where the cutting to length is made with the second cutting device 7) but as emergency mode. The first cutting device 4 is also used during the step of starting the continuous casting and rolling process both in the endless and in the semi-endless mode, as described above.

Preferably, also during the aforesaid time t from the reaching of the emergency speed v', the second cutting device 7 continues scrapping the billet producing billet pieces which are unloaded in the collection container 9.

When the maximum storage capacity of the bed or discharging table 5 is reached, the cutting device 4 can scrap the advancing billet, and the billet pieces obtained will be unloaded into the collection container 14 or into another suitable collection device.

During steps a), b) and c) it is possible to intervene in the rolling train 8, for example, by eliminating a cobble, or by changing some worn components, or by changing the section of the rolling channels, etc.

When the billet, which advances at the emergency speed v', is cut during step c) by the first cutting device 4, the billet segments 15 thus obtained are unloaded laterally on the bed 5. Once finished the intervention in the rolling train 8, an increase of the casting speed is provided, from the emergency speed v' to the second speed $v_2$, so that it is possible to return to the preceding operation at full capacity, in an endless or semi-endless mode.

Alternatively to the variant described in the previous paragraph, after step c), while the intervention in the rolling train 8 is still ongoing for putting it back into operation, a step d) is provided, in which a first increase in the casting speed, from the emergency speed v' to the first casting speed $v_1$, is provided so that billet segments can be produced at a greater speed, obtained by means of the first cutting device 4 and unloaded on the bed 5. Once finished the intervention in the rolling train 8, a second increase of the casting speed is provided, from the first casting speed $v_1$ to the second speed $v_2$, so that it is possible to return to the preceding operation at full capacity, in an endless or semi-endless mode.

The invention claimed is:

1. An emergency procedure for a continuous casting and rolling plant for a continuous production of steel bars or profiles, the plant comprising in sequence, along a processing line a continuous casting machine adapted to cast a billet;

a first cutting device;

at least one bed;

a second cutting device;

a rolling train adapted to roll the billet;

wherein the continuous casting machine comprises a crystallizer, and is adapted to cast the billet at least at a first casting speed $v_1$ and at a second casting speed $v_2$ greater than the first casting speed $v_1$;

wherein the first cutting device is arranged at a first distance A from the crystallizer expressed in meters, along the processing line, calculated according to the following relation:

$$v_1 \cdot \left(\frac{d_{min}}{k}\right)^2 < A < v_2 \cdot \left(\frac{d_{min}}{k}\right)^2$$

wherein $d_{min}$=minimum distance between the center of the billet and an outer surface of the billet, expressed in mm, considering the maximum cross section of the billet according to a plant design, k=solidification coefficient, expressed in $mm/min^{0.5}$, and wherein the first casting speed $v_1$, expressed in m/min, is the maximum casting speed at which a closure of the liquid cone of the billet occurs before said at least one bed;

and the second casting speed $v_2$, expressed in m/min, is the maximum casting speed at full capacity according to the plant design;

the emergency procedure, for said plant working at full capacity at said second casting speed $v_2$, comprises the following steps:

a) cutting the billet by means of the second cutting device;

b) reducing the casting speed of the continuous casting machine from the second casting speed $v_2$ to a third casting speed v', lower than the first casting speed $v_1$;

c) cutting the billet by means of the first cutting device.

2. The procedure according to claim 1, wherein step c) starts after a time t from the reaching of said third casting speed v';

wherein the time t is given by the following relation:

$$t \geq \left(\frac{d_{min}}{k}\right)^2 * \left(\frac{v_2 - v_1}{v_2 - v'}\right).$$

3. A process according to claim 2, wherein the following relation exists between the first casting speed $v_1$ and the second casting speed $v_2$:

$$v_1 \leq 0.7 v_2.$$

4. The procedure according to claim 1, wherein the first casting speed $v_1$ has a value in the range from 4.1 m/min to 5 m/min, the second casting speed $v_2$ has a value in the range from 5.1 m/min to 9 m/min, and the third casting speed v' has a value in the range from 3 m/min to 4 m/min.

5. The procedure according to claim 1, wherein said third casting speed v', expressed in m/min, is the minimum casting speed according to the plant design.

6. The procedure according to claim 1, wherein the solidification coefficient k is equal to a value in the range from 27 to 32 mm/min$^{0.5}$.

7. The procedure according to claim 1, wherein when the billet is cut during step c), one or more billet portions or segments are unloaded on the bed.

8. The procedure according to claim 1, wherein during step b), and also during the time from the reaching of said third casting speed v', the second cutting device continues cutting the billet; while during step c) the second cutting device does not cut the billet.

9. The procedure according to claim 1, wherein during step a) cutting the billet by means of the second cutting device consists in scrapping the billet, and wherein, during step c), cutting the billet by means of the first cutting device consists in cutting the billet to length to produce billet segments to be unloaded on the bed.

10. The procedure according to claim 1, wherein once finished an intervention in the rolling train, after the step c) there is provided an increase of the casting speed from said third casting speed v' to the second casting speed $v_2$ so that it is possible to return to said plant working at full capacity, in an endless or semi-endless mode.

11. The procedure according to claim 10, wherein in the semi-endless mode, once reached the second casting speed $v_2$, the first cutting device stops the cutting action thereof and the second cutting device starts cutting billet segments to length, feeding the rolling train.

12. The procedure according to claim 10, wherein in the endless mode, once reached the second casting speed $v_2$, which coincides with the speed of the rolling train, the first cutting device stops the cutting action thereof.

13. A process according to claim 11 or 12, wherein, during said increase of the casting speed from said third casting speed v' to the second casting speed $v_2$, the first cutting device cuts billet segments to length, feeding the rolling train.

14. A continuous casting and rolling plant for a continuous production of steel bars or profiles, adapted to perform the emergency procedure according to claim 1, the plant comprising in sequence, along a processing line a continuous casting machine adapted to cast a billet;

a first cutting device;

at least one bed;

a second cutting device;

a rolling train adapted to roll the billet;

wherein the continuous casting machine comprises a crystallizer, and is adapted to cast the billet at least at a first casting speed $v_1$ and at a second casting speed $v_2$ greater than the first casting speed $v_1$;

wherein the first cutting device is arranged at a first distance A from the crystallizer expressed in meters, along the processing line, calculated according to the following relation:

$$v_1 \cdot \left(\frac{d_{min}}{k}\right)^2 < A < v_2 \cdot \left(\frac{d_{min}}{k}\right)^2$$

wherein $d_{min}$=minimum distance between the center of the billet and an outer surface of the billet, expressed in mm, considering the maximum cross section of the billet according to a plant design, k=solidification coefficient, expressed in mm/min$^{0.5}$, and wherein the first casting speed $v_1$, expressed in m/min, is the maximum casting speed at which a closure of the liquid cone of the billet occurs before said at least one bed;

and the second casting speed $v_2$, expressed in m/min, is the maximum casting speed at full capacity according to the plant design.

15. The plant according to claim 14, wherein the first distance A is lower than 50 meters.

16. The plant according to claim 14, wherein said processing line comprises a curved stretch, comprising a casting curve, and a rectilinear stretch along which said first cutting device and second cutting device are arranged.

17. The plant according to claim 16, wherein a straightening unit is provided between said curved stretch and said rectilinear stretch.

18. The plant according to claim 17, wherein a second distance B between 10 and 20 m is provided between the straightening unit and the first cutting device.

19. The plant according to claim 14, wherein a distance C between 35 and 40 m is provided between the first cutting device and the second cutting device.

20. The plant according to claim 14, wherein at least one heating furnace is arranged between the at least one bed and the second cutting device or between the second cutting device and the rolling train.

21. The plant according to claim 14, wherein a distance D between 70 and 95 m is provided between the crystallizer and the rolling train.

* * * * *